US005144819A

United States Patent [19]

Hiyama et al.

[11] Patent Number: 5,144,819

[45] Date of Patent: Sep. 8, 1992

[54] CONTROLLER OF A WASHING MACHINE

[75] Inventors: Isao Hiyama; Yoshio Niwase; Yousuke Nagano; Shigeharu Nakano, all of Hitachi; Tamotu Shikamori, Ibaraki, all of Japan

[73] Assignee: Hitachi, Ltd., Tokyo, Japan

[21] Appl. No.: 659,678

[22] Filed: Feb. 25, 1991

[30] Foreign Application Priority Data

Feb. 28, 1990 [JP] Japan ..... 2-045420

[51] Int. Cl.[5] ..... D06F 33/02

[52] U.S. Cl. ..... 68/12.04; 68/12.05

[58] Field of Search ..... 68/12.04, 12.05

[56] References Cited

U.S. PATENT DOCUMENTS 4,779,430 10/1988 Thuruta et al. ..... 68/12.04

FOREIGN PATENT DOCUMENTS 0036556 9/1984 Japan ..... 68/12.04
0156491 8/1985 Japan ..... 68/12.04
0085993 5/1986 Japan ..... 68/12.05
0185298 8/1986 Japan ..... 68/12.05
0008794 1/1987 Japan ..... 68/12.05
0121099 5/1989 Japan ..... 68/12.05

*Primary Examiner*—Philip R. Coe
*Attorney, Agent, or Firm*—Antonelli, Terry, Stout & Kraus

[57] ABSTRACT

A washing machine includes a washing and water-extracting tub, agitating blades disposed rotatably in the tub, a motor for rotating the tub or the agitating blades and a control unit for controlling operation of the motor and determining a quantity of clothes on the basis of a resistance of the clothes exerted on the agitating blades by the rotation of the agitating blades. The washing machine determines the quantity of clothes plural times while a water level is changed from a low water level to a high water level and makes calculation on the basis of the plurality of determination values to determine a kind of clothes or the quality of cloth so that the washing operation is controlled on the basis of the quantity of clothes and the determined quality of cloth.

6 Claims, 6 Drawing Sheets

CONTROLLER OF A WASHING MACHINE

BACKGROUND OF THE INVENTION

The present invention relates to an operation control of a washing machine which detects a quantity of clothes and a kind of clothes and performs optimum operation control.

A conventional washing machine determines a flow of water and a washing time in accordance with only a quantity of clothes. For example, when the quantity of clothes is small, the flow of water is weak and the washing time is short, while when the quantity of clothes is large, the flow of water is strong and the washing time is long. Accordingly, when a small quantity of large-size clothes such as sheets and bath towels is washed, the washing force is weak, while when a large quantity of thin clothes such as lingerie is washed, the flow of the water is strong and the washing time is long thus, the clothes are worn out more quickly. Thus, optimum operation control for the washing machine is not found.

SUMMARY OF THE INVENTION

It is an object of the present invention to provide a washing controller which automatically selects a proper water level, a strength of a flow of water, a washing time, a rinsing time and a water-extracting time in accordance with a quantity and a kind of clothes.

According to the present invention, a quantity of clothes is determined on the basis of a resistance exerted on agitating blades of the washing machine and a water level is changed from a minimum water level to further determine a quantity of clothes so that the plurality of determination values for the quantity of clothes are comparatively calculated to determine the kind of clothes.

DESCRIPTION OF THE PREFERRED EMBODIMENT

Figure 1:
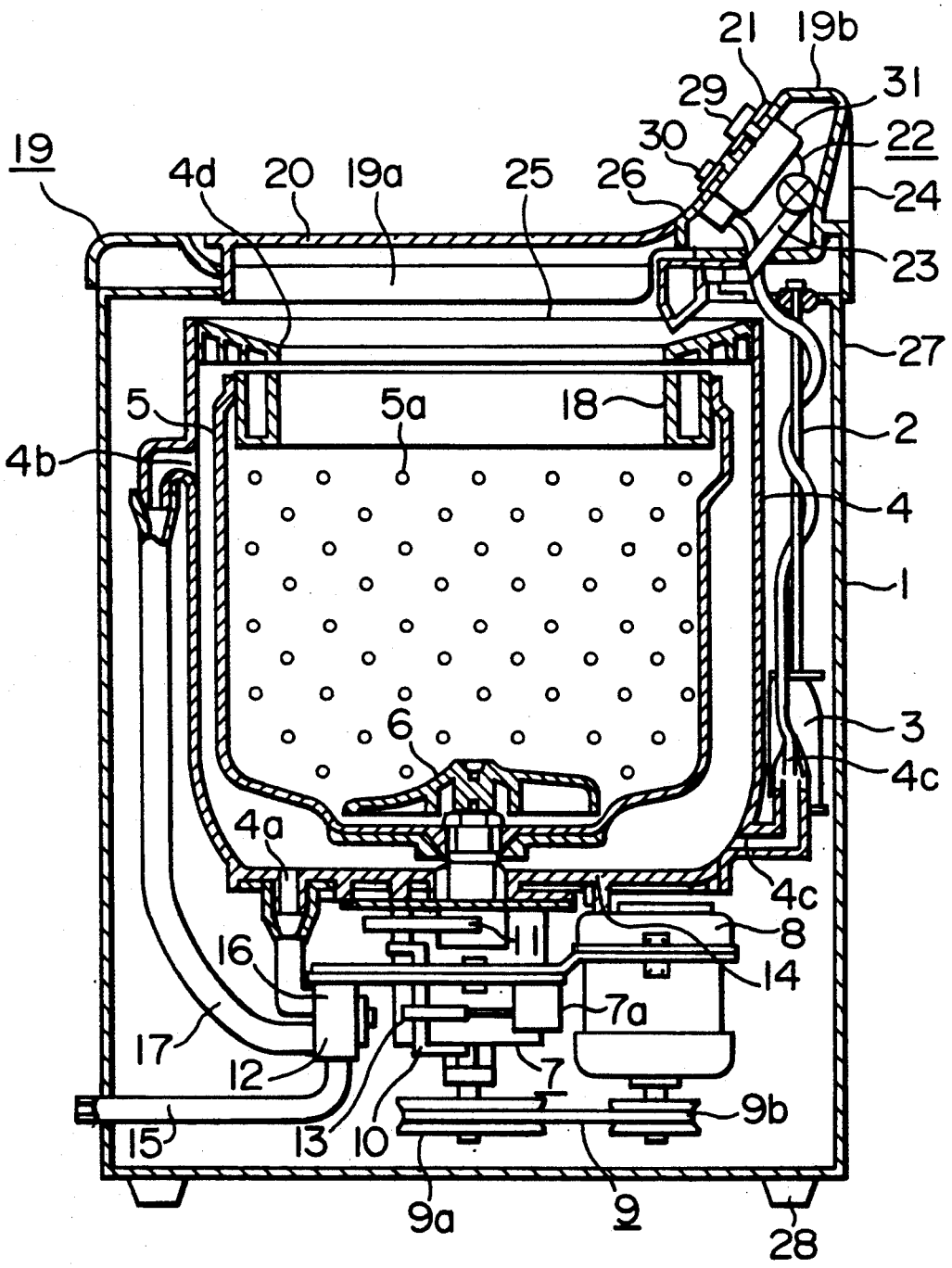
FIG. 1 is a sectional view of a fully-automatic washing machine according to an embodiment of the present invention.

An embodiment of the present invention is described with reference to the drawings. A washing machine illustrating the embodiment of the present invention, is, as shown in FIG. 1, includes an outer tank 4 of synthetic resins suspended in an outer frame 1 of steel plate by means of suspension rods 2 and vibration-proof devices 3 such as a coil spring or an elastic rubber. There are four suspension rods 2 and four vibration-proof devices 3.

A washing and water-extracting tub 5 of synthetic resins is rotatably disposed in the outer tank in which washing water is accumulated. The washing and water-extracting tub 5 is formed with a plurality of water-extracting holes 5*a* and includes a rotator 6 such as a pulsator or an agitator disposed at a center bottom thereof. The washing and water-extracting tub 5 is stopped from rotated or stands still in the washing and rinsing operation and the rotator 6 is rotated clockwise and counterclockwise. Further, the washing and water-extracting tub is rotated unidirectionally in the water-extracting operation. The rotator 6 and the washing and water-extracting tub are rotated by a driving device 7.

The driving device 7 comprises a motor 8, a transmission device 9 including a pulley 9*a* and a belt 9*b* for transmitting rotation of the motor 8 to the rotator 6 or the washing and water-extracting tub 5, a clutch device 10 for rotating only the rotator 6 in the washing and rinsing operation or for rotating the washing and water-extracting tub 5 in the water-extracting operation, a solenoid 7*a* for switching the clutch device 10 and a drainage device 12 for draining water.

The driving device 7 is fixedly mounted on the bottom of the outer frame 4 by means of a support steel plate 15. The outer frame 4 is formed with an inlet 4*c* connected to a P.S. tube 27 for transmitting a pressure of water in the outer frame 4 to a water level sensor 26.

Disposed in an upper portion of the outer frame 1 is a top cover 19 of synthetic resins provided with an opening 19*a* through which the wash is put into the tub and an operation box 19*b* containing electric parts or devices such as a controller and the like. The opening 19*a* is provided with a lid 20 of synthetic resin.

An operation panel 21 is mounted in the upper surface of the operation box 19*b* and a solenoid-operated type water supply valve 24 is provided in the operation box 19*b*.

The water level sensor 26 disposed in the operation box 19*b* detects a pressure of water in the outer frame 4 to determine whether the water is accumulated to a prescribed water level or not. The water level sensor 26 includes a core, a coil, a spring and the like.

A controller for controlling the washing, rinsing and water-extracting operation is disposed in a container box 31.

A power switch button 29 and an external operation switch 30 are disposed in the operation panel 21.

Figure 2:
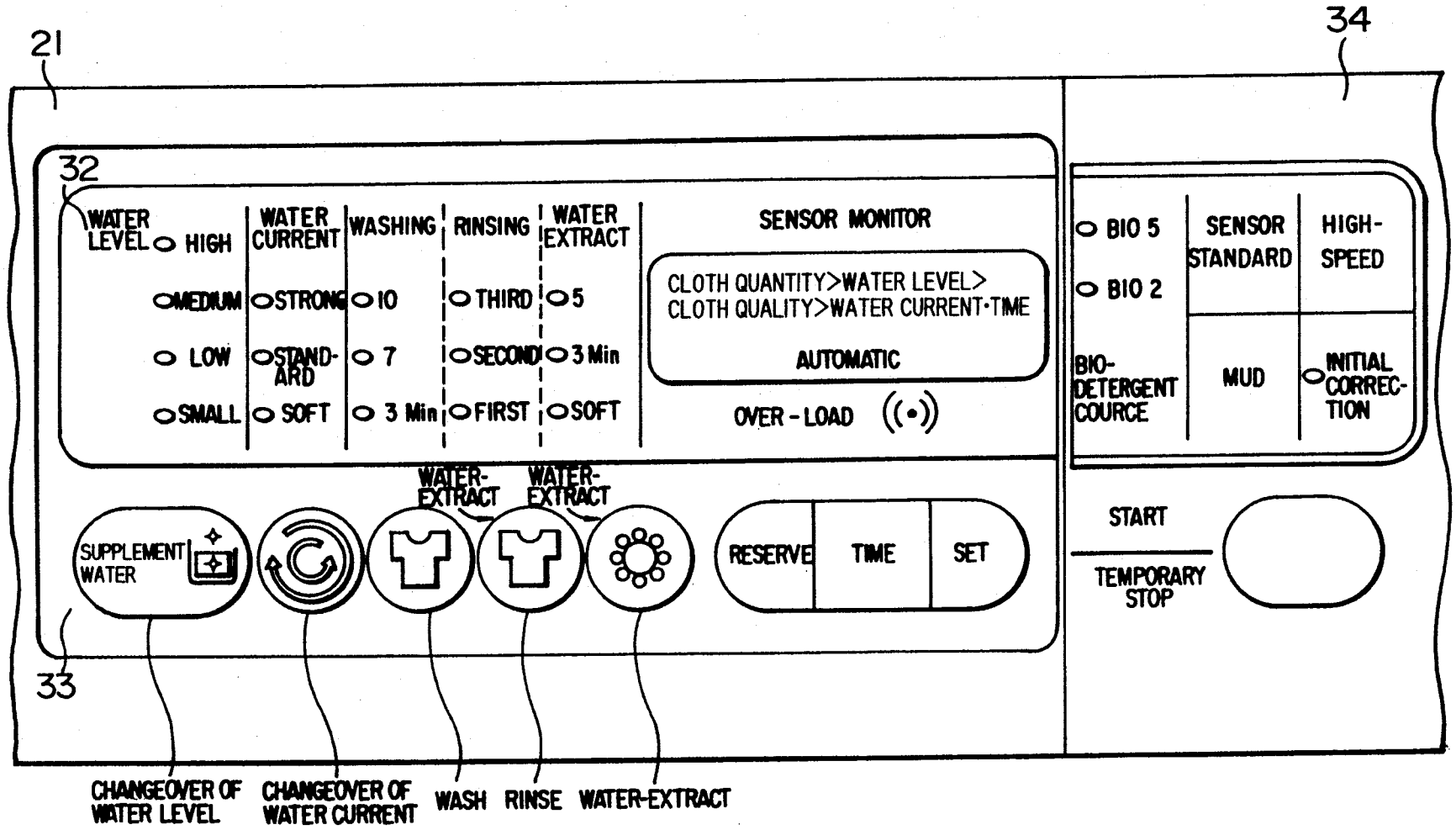
FIG. 2 schematically illustrates an operation panel.

FIG. 2 shows the operation panel 21.

The operation panel 21 includes a display portion 32, a ① operation portion 33 and a ② operation portion 34. The display portion 32 displays information concerning water level, water current, washing, rinsing, water extraction and sensor monitor in response to the state of operation. The ① operation portion 33 includes selection switch buttons for selectively setting a water level, a water current, a washing time, a rinsing course and a water-extracting time. The ② operation portion 34 includes selection switch buttons for selectively setting a bio-detergent course, a standard sensor level, a muddy course and the like.

Figure 3:
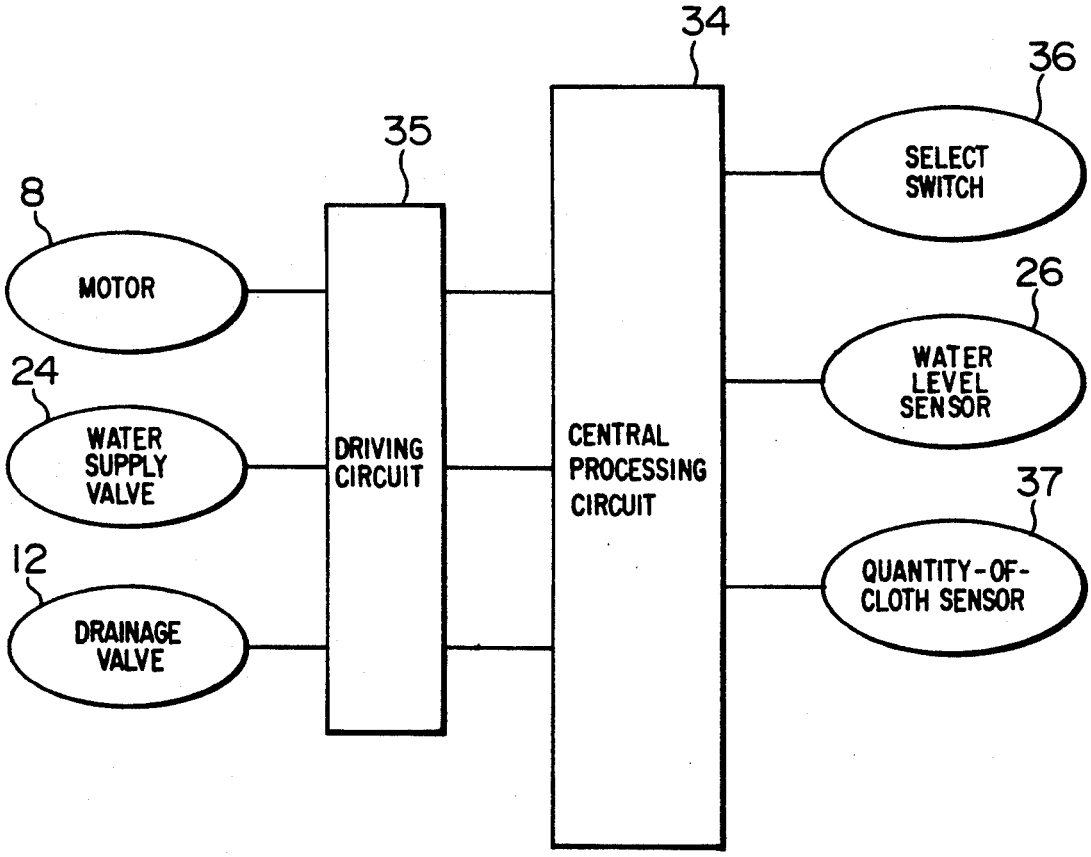
FIG. 3 is a circuit diagram schematically illustrating the whole configuration of a washing machine.

FIG. 3 shows a simplified circuit of the whole configuration of the washing machine. A central processing circuit 34 and a driving circuit 35 are integrated as a controller and disposed within a container 31. There are provided the motor 8, a drainage valve acting as the drainage device 12, a selection switch for washing, rinsing, water-extraction and the like, the water level sensor 26 and a quantity-of-cloth sensor 37 for determining a quantity of cloth.

Figure 4:
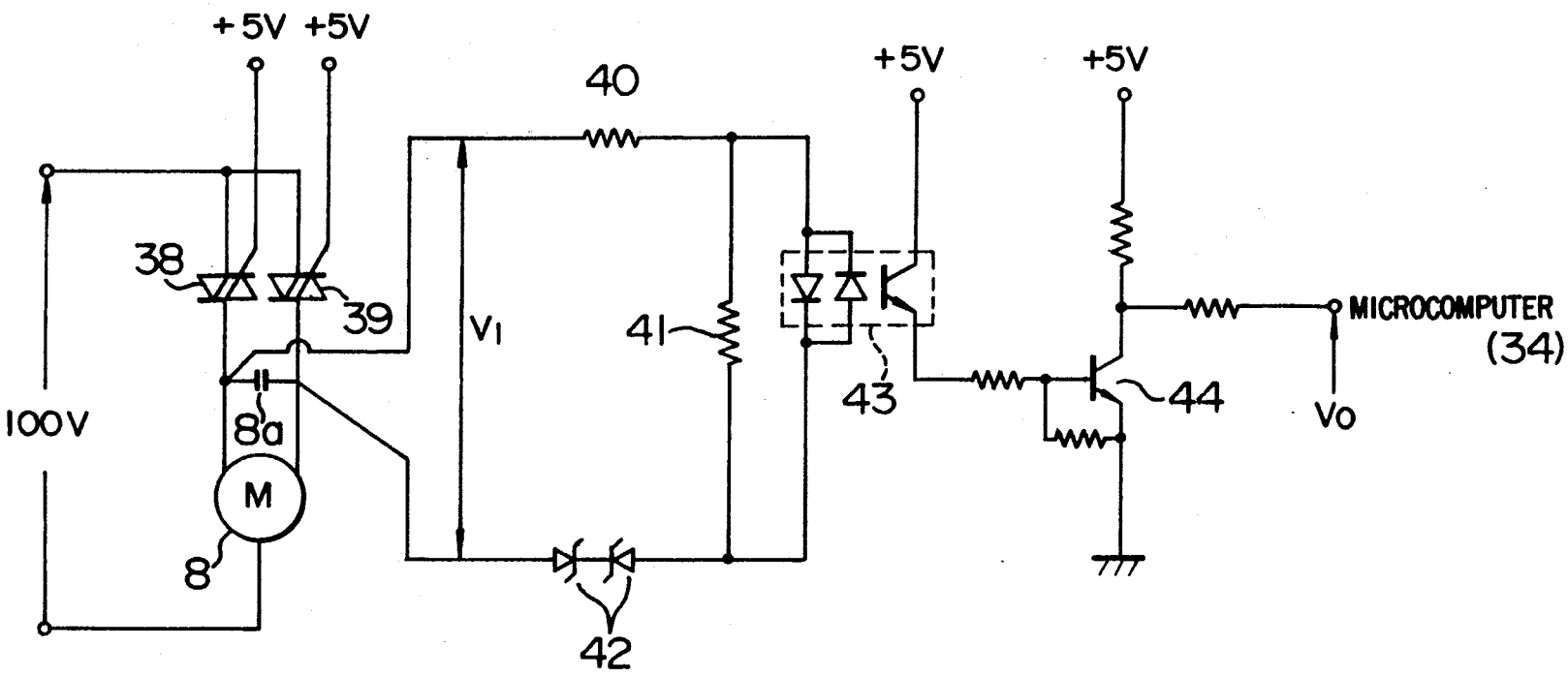
FIG. 4 is a circuit diagram for detecting a quantity of cloth.

FIG. 4 is a circuit diagram of the quantity-of-cloth sensor 37 for determining a quantity of cloth. The motor 8 for rotating the agitating blades and the washing and water-extracting tub 5 of the washing machine includes a phase leading condenser 8a connected thereacross. FLS's 38 and 39 are switches for switching the rotation direction of the motor 8. A series connection of resistors 40 and 41 and zener diodes 42 is connected across the condenser 8a. A photo-transistor 43 is connected in parallel with the resistor 41. An output of the photo-transistor 43 is coupled with a base of a wave-shaping transistor 44. An output of the transistor 44 is incorporated into a microcomputer of the central processing circuit 34.

With the above configuration, when the power switch button 29 is pressed to turn on a power switch and the "standard sensor level" button of the external operation switch 30 is pressed, the solenoid-operated water supply valve 24 is energized in response to a signal from the controller so that water is supplied into the washing and water-extracting tub. At this time, the solenoid 7a is also energized and the washing machine is placed in a water-extraction state. The motor is driven to be turned on for 0.5 second and turned off for 4 seconds so that the washing and water-extracting tub is rotated slowly in one direction and the washing in the tub is exposed to water uniformly.

When the water level sensor 26 detects that the water reached has the minimum water level, energization of the water supply valve 26 and the solenoid 7a is stopped and the motor 8 is energized for agitation. At this time, since the clutch device 10 is in the water-extraction state, the clutch device 10 is set in a washing state, Further, in order to prevent the cloth from being damaged or worn, the washing machine is operated for 8 seconds with reverse water current agitation the reverse water current agitation is stronger than agitation for detection of a quantity of cloth and weaker than normal agitation. The reverse water current agitation is turned on for 0.5 second and turned off for 0.5 second, and the agitation for detection of a quantity of cloth is then performed.

Figure 5:
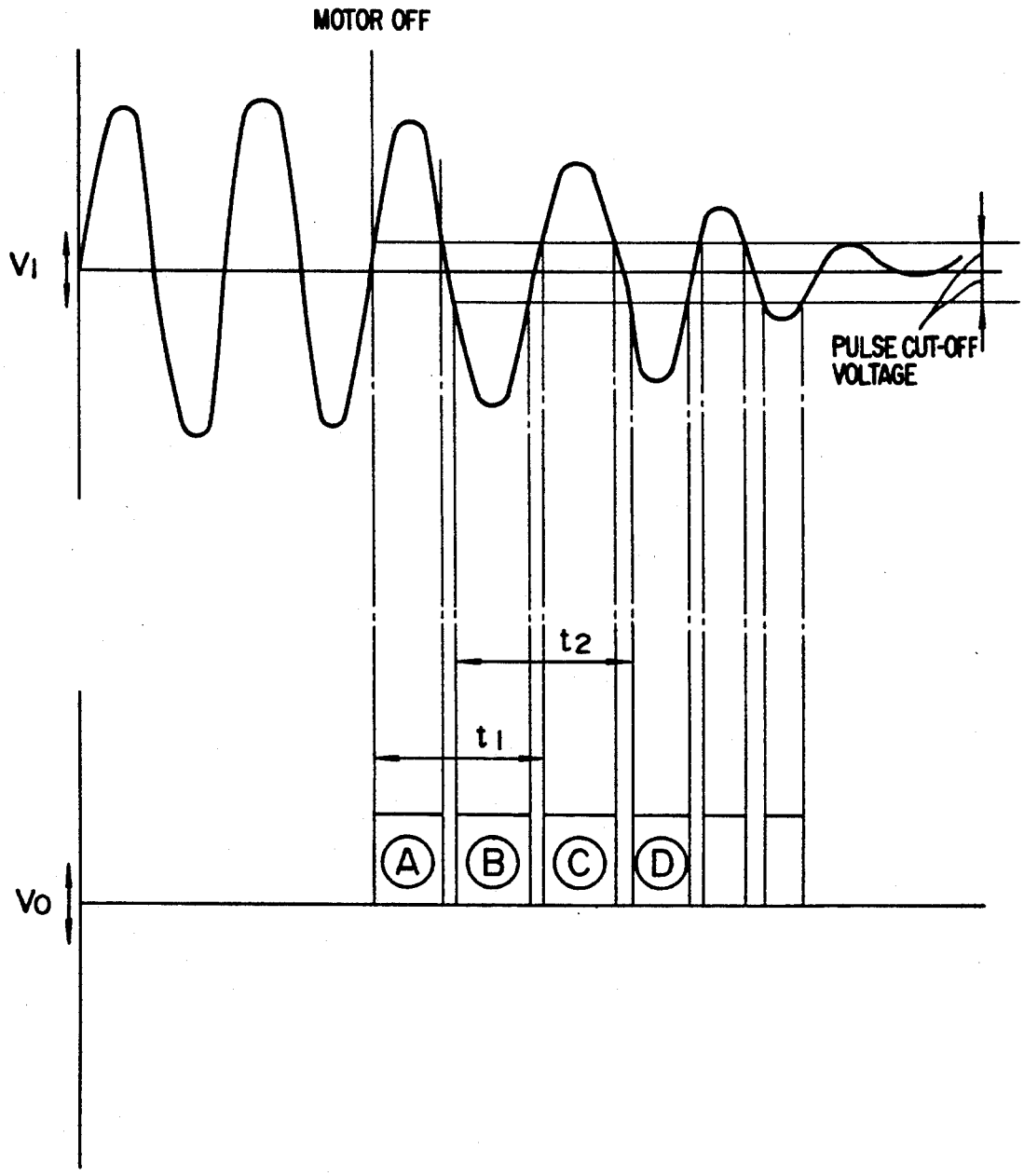
FIG. 5 shows an output of a quantity-of-cloth sensor.

In the detection of a quantity of cloth, the reverse agitation is turned on for 0.4 second and off for 1 second, and the counter electromotive force of the motor 8 generated when the rotator 6 is rotated by inertia while the reverse agitation is turned off is detected as a terminal voltage across the condenser 8a, which drives the motor 8. The counter electromotive force is converted into a dc square pulse, and a time tl between the pulses is measured to determine a quantity of cloth. More particularly, when the quantity of cloth is large and since the resistance to the rotator 6 is large, the inertial rotation of the rotator 6 is prevented and the time tl between the pulses is long. On the other hand, when a quantity of the wash is small, the time tl between the pulses is short. The measurement of the time between the pulses is made by measuring a time duration tl between rising edges of a first pulse Ⓐ and a third pulse Ⓒ (FIG. 5) and is full-wave detected by the circuit shown in FIG. 4. This measurement is repeated 20 times, and a total time thereof is compared with times of a relationship between washing quantities and the times which have been stored previously in the microcomputer to determine a washing quantity so that the water level is automatically set in accordance with the washing quantity, and the water is supplied to the water level.

Further, during the process of supplying the water to the optimum water level, a detection water level is changed and the detection process of a quantity of cloth is performed to measure a time duration tl between the rising edges of the pulses. For example, when a washing quantity of 4.0 kg is determined as a high water level, the detection process of a quantity of cloth is performed four times and the time durations tl between the rising edges of pulses at various water levels for the washing having different kinds of clothes (large-size clothes such as sheet and bath towel and thin clothes of synthetic fiber such as lingerie) are shown in FIG. 6.

(1) A difference ΔT between time durations tl of the rising edges of pulses at the minimum water level and the optimum water level is calculated.

Figure 6:
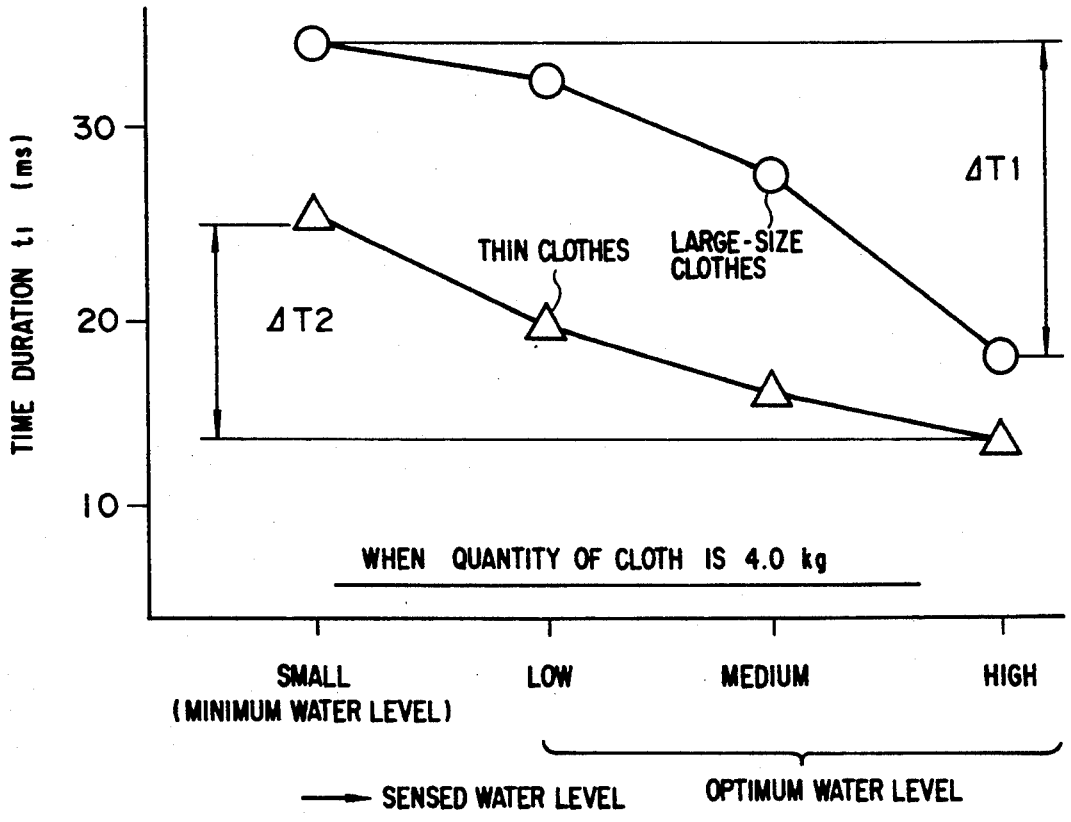
FIG. 6 is a graph of measurement data showing detection of kinds of clothes.

(2) An average change rate m is calculated from an approximate function of curves in the graph shown in FIG. 6.

Thus, the kind of clothes can be determined on the basis of the difference ΔT between time durations tl of the rising edges of pulses and the change rate m in the case when the detection water level is changed. For example, since the values ΔT and m for the large-size clothes such as sheets and bath towels are large whereas those for the thin clothes of synthetic resin such as lingerie is small, the values are compared with constants stored in a table in accordance with the kinds of clothes established previously in the microcomputer of the controller to set a strength of water current (an energization time for the motor controlled by a ratio of on time and off time and a rotational number of the motor), a washing time, a rinsing time, and a water-extraction time. Thus, large-size clothes are washed with strong water current for a long time, and thin clothes of synthetic resin are washed with weak water current for a short time, so that washing control can be made to match various clothes. Further, since the difference ΔT and the change rate m calculated by the determination method of a kind of cloth are different depending on water levels (high, medium and low water levels), the table constants for various cloths set in the microcomputer of the controller can be set for each water level to determine a kind of clothes with higher accuracy.

In the foregoing description, a washing quantity is determined by using the quantity-of-cloth sensor 37 and the water level is automatically set in accordance with the washing quantity. When the water level is set manually by a user, the manual set has priority over the one that is automatically set. Sensed data of a quantity of cloth at the minimum water level is supplied to the central processing circuit, before the washing operation is made at the manually set water level. For example, when a water level is manually set to a high water level, the supply of water is stopped at the minimum water level to detect a quantity of cloth by the quantity-of-cloth sensor 37 at its water level and water is then added to reach a low water level to make the same detection, and the same operation is repeatedly made at a medium water level and a high water level. Further, when the water level is manually set to the low water level and the medium water level, the same operation is made until the water level reaches the manually set water level.

According to the present invention, a quantity and a kind of the washing can be detected to automatically determine the optimum water current, washing time, rising time and the like so that washing process can be set in accordance with the quantity and kind of the washing to improve washing force for large-size clothes and reduce wear of thin clothes.

We claim:

1. An operation controller of a washing machine comprising a washing tub, an agitating blade rotatably disposed in said washing tub, a motor for rotating said agitating blade and control means for controlling operation of said motor in accordance with a kind of clothes, wherein said control means includes measuring means for measuring a value representing a kind of clothes to be washed, said measuring means including rotation means for measuring a rotation of said agitating blade a plurality of times while a water level of the washing tub is changed starting from a low water level, resistance means for measuring resistance values of clothes exerted on said agitating blade from the rotation of said agitating blade as the water level is changed and calculation means for calculating the value representing the kind of clothes from the resistance values of the clothes.

2. An operation controller of a washing machine comprising a washing tub, an agitating blade rotatably disposed in said washing tub, a motor for rotating said agitating blade and control means for controlling an operation of said motor, wherein said control means includes measuring means for measuring a value representing a kind of clothes to be washed, said measuring means including rotation means for measuring a rotation of said agitating blade a plurality of times while a water level of said washing tub is changed from a low water level to a predetermined water level, resistance means for measuring resistance values of clothes exerted on said agitating blade from the rotation of said agitating blade as the water level is changed and calculation means for calculating the value representing the kind of clothes from the resistance values of the clothes.

3. A washing controller of a washing machine including a washing and water-extracting tub, an agitating blade, a motor for driving the washing and water-extracting tub or the agitating blade and control means for controlling energization of said motor, wherein said control means includes measuring means for measuring a first value representing a kind of clothes to be washed, said measuring means including resistance means for measuring a resistance of clothes exerted on said agitating blade, determining means for measuring a second value representing a quantity of clothes from the resistance, optimum water level means for determining an optimum water level from the second value representing a quantity of the clothes, and calculation means for calculation of the first value representing the kind of clothes from measuring a plurality of second values representing the quantity of clothes, wherein the plurality of second values is measured by detecting the quantity of clothes plural times while a water level of the washing and water-extracting tub is changed from a minimum water level to a maximum water level and the calculation means calculates the kind of clothes by comparing the second values.

4. A washing controller of a washing machine according to claim 3, wherein the determining means measures the second value representing the quantity of clothes at a minimum water level and a maximum water level and the calculation means calculates the first value representing the kind of clothes from the quantity of clothes at the minimum water level and the quantity of clothes at the maximum water level.

5. A washing controller of a washing machine according to claim 4, wherein the control means controls a strength of water current, a washing time, a rinsing time and a water-extraction time in response to the kind of clothes.

6. A washing controller of a washing machine according to claim 3, wherein the control means controls a strength of water current, a washing time, a rinsing time and a water-extraction time in response to the first value.

* * * * *